US010774536B2

(12) United States Patent
Hornstein

(10) Patent No.: US 10,774,536 B2
(45) Date of Patent: Sep. 15, 2020

(54) RAINWATER GUTTER

(71) Applicant: David Hornstein, Sudbury, MA (US)

(72) Inventor: David Hornstein, Sudbury, MA (US)

( * ) Notice: Subject to any disclaimer, the term of this patent is extended or adjusted under 35 U.S.C. 154(b) by 0 days.

(21) Appl. No.: 16/534,414

(22) Filed: Aug. 7, 2019

(65) Prior Publication Data

US 2019/0360210 A1 Nov. 28, 2019

(51) Int. Cl.
*E04D 13/068* (2006.01)
*E04D 13/064* (2006.01)

(52) U.S. Cl.
CPC ..... *E04D 13/068* (2013.01); *E04D 13/0641* (2013.01)

(58) Field of Classification Search
CPC . E04D 13/064; E04D 13/0641; E04D 13/068; E04D 13/0685; E04D 13/072; E04D 13/0722; E04D 13/0725; E04D 13/0727
See application file for complete search history.

(56) References Cited

U.S. PATENT DOCUMENTS 1,682,840 A * 9/1928 Foerch, Jr. ..... E04D 13/068 405/122
3,169,346 A * 2/1965 Sklar ..... E04D 13/15 52/15
3,841,101 A * 10/1974 Henfrey ..... E04D 13/068 405/122
3,913,284 A * 10/1975 Hall ..... E04D 13/0645 52/11
4,190,988 A * 3/1980 Carreiro ..... E04D 13/064 52/11
4,257,716 A * 3/1981 Woodrow ..... E04D 13/0641 405/118
5,038,528 A * 8/1991 Brant ..... E04D 13/068 248/48.1
5,216,852 A * 6/1993 Bemis ..... E04D 13/064 248/48.1
5,435,105 A * 7/1995 Visser ..... E04D 13/064 52/12
5,537,785 A * 7/1996 Zaccagni ..... E04D 13/064 52/11
7,306,402 B2 * 12/2007 Graber ..... E02B 5/02 405/121
8,549,791 B1 * 10/2013 Loughren ..... E04D 13/158 52/11
9,963,881 B1 * 5/2018 Aleman ..... E04D 13/068
2003/0056437 A1 * 3/2003 Costa ..... A01G 31/02 47/62 R
2004/0040219 A1 * 3/2004 Bacik ..... E04D 13/064 52/11
2005/0115159 A1 * 6/2005 Brown ..... E04D 13/0641 52/11

(Continued)

*Primary Examiner* — Brian D Mattei
(74) *Attorney, Agent, or Firm* — Barry Choobin; Patent 360

(57) ABSTRACT

The present invention is directed to a rainwater gutter for collecting rainwater which runs off the roof of a building. The rainwater gutter is formed by connecting two or more gutter sections, such as the outer surface of the gutter is continuous with no visible connectors. The gutter sections comprise one or more keyways running along the length of the gutter section. The keyways receive an elongated keyway for connecting gutter sections end to end.

19 Claims, 5 Drawing Sheets

(56) References Cited

U.S. PATENT DOCUMENTS

| | | | | |
|---|---|---|---|---|
| 2007/0234648 | A1* | 10/2007 | Tombazzi | E04D 13/064<br>52/12 |
| 2014/0318030 | A1* | 10/2014 | Degenhardt | E04D 13/076<br>52/12 |
| 2019/0376294 | A1* | 12/2019 | Williams | E04D 15/00 |

* cited by examiner

RAINWATER GUTTER

FIELD OF INVENTION

The present invention relates to a rainwater gutter, more particularly relates to mountable rainwater gutter sections that can be joined together to form the rainwater gutter.

BACKGROUND

A rainwater gutter is typically mounted along the roofline, just below the edge of the roof for collecting the rainwater which runs off of the roof. The gutter is, in turn, joined to a downspout for carrying the rainwater from the rain gutter. Gutters made of wood have long been used in the past, these generally are elongated gutters assemblies connected at their ends and corners in a way that provided a smooth, continuous appearance of the gutter on the outside faces. The wood had been slowly replaced by aluminum, being less expensive, easier to install and does not rot like wood.

The aluminum gutters are typically made in sections, which are connected together through connectors. The rainwater gutters fit inside the connectors, which leaves the connectors visible on the outside faces of the gutter. Because of the planar difference between the connector and the rainwater gutters, aluminum gutters have a different appearance than wood gutters.

It is desirable to replicate the look of a traditional gutter when building or repairing a building. Thus, a need is appreciated for a gutter assembly with continuous outside faces and no visible connectors, thereby replicating the appearance of a wood gutter

SUMMARY OF THE INVENTION

Therefore, the principal objective of the present invention is directed to a rainwater gutter.

An additional objective of the present invention is that the rainwater gutter has a continuous outside face without any visible connectors.

A further objective of the present invention is that the rainwater gutter can be produced in sections that can be joined together easily.

Still further objective of the present invention is that the rainwater gutter is made by extrusion process.

Still further objective of the present invention is that the gutter sections of desired length can be cut from a gutter.

Still further objective of the present invention is that the rainwater gutter can be easily mounted to the roof.

Another objective of the present invention is that the rainwater gutter does not allow leaves, twigs and like to collect in the gutter.

Still another objective of the present invention is that the rainwater gutter could be easily cleaned.

Yet another objective of the present invention is that the rainwater gutter is durable and can withstand external damaging forces.

BRIEF DESCRIPTION OF THE DRAWINGS

The accompanying figures, which are incorporated herein, form part of the specification and illustrate embodiments of the present invention. Together with the description, the figures further serve to explain the principles of the present invention and to enable a person skilled in the relevant arts to make and use the invention.

DETAILED DESCRIPTION

The present invention is directed to a rainwater gutter for collecting rainwater which runs-off of the roof of a building, and more particularly the present invention is directed to a gutter section having one or more keyways for connecting it to another gutter section.

Subject matter will now be described more fully hereinafter with reference to the accompanying drawings, which form a part hereof, and which show, by way of illustration, specific exemplary embodiments. Subject matter may, however, be embodied in a variety of different forms and, therefore, covered or claimed subject matter is intended to be construed as not being limited to any exemplary embodiments set forth herein; exemplary embodiments are provided merely to be illustrative. Likewise, a reasonably broad scope for claimed or covered subject matter is intended. Among other things, for example, the subject matter may be embodied as methods, devices, components, or systems. The following detailed description is, therefore, not intended to be taken in a limiting sense.

The word "exemplary" is used herein to mean "serving as an example, instance, or illustration." Any embodiment described herein as "exemplary" is not necessarily to be construed as preferred or advantageous over other embodiments. Likewise, the term "embodiments of the present invention" does not require that all embodiments of the invention include the discussed feature, advantage or mode of operation.

The terminology used herein is for the purpose of describing particular embodiments only and is not intended to be limiting of embodiments of the invention. As used herein, the singular forms "a", "an" and "the" are intended to include the plural forms as well, unless the context clearly indicates otherwise. It will be further understood that the terms "comprises", "comprising,", "includes" and/or "including", when used herein, specify the presence of stated features, integers, steps, operations, elements, and/or components, but do not preclude the presence or addition of one or more other features, integers, steps, operations, elements, components, and/or groups thereof.

The following detailed description includes the best currently contemplated mode or modes of carrying out exemplary embodiments of the invention. The description is not to be taken in a limiting sense but is made merely for the purpose of illustrating the general principles of the invention, since the scope of the invention will be best defined by the allowed claims of any resulting patent.

Figure 1:
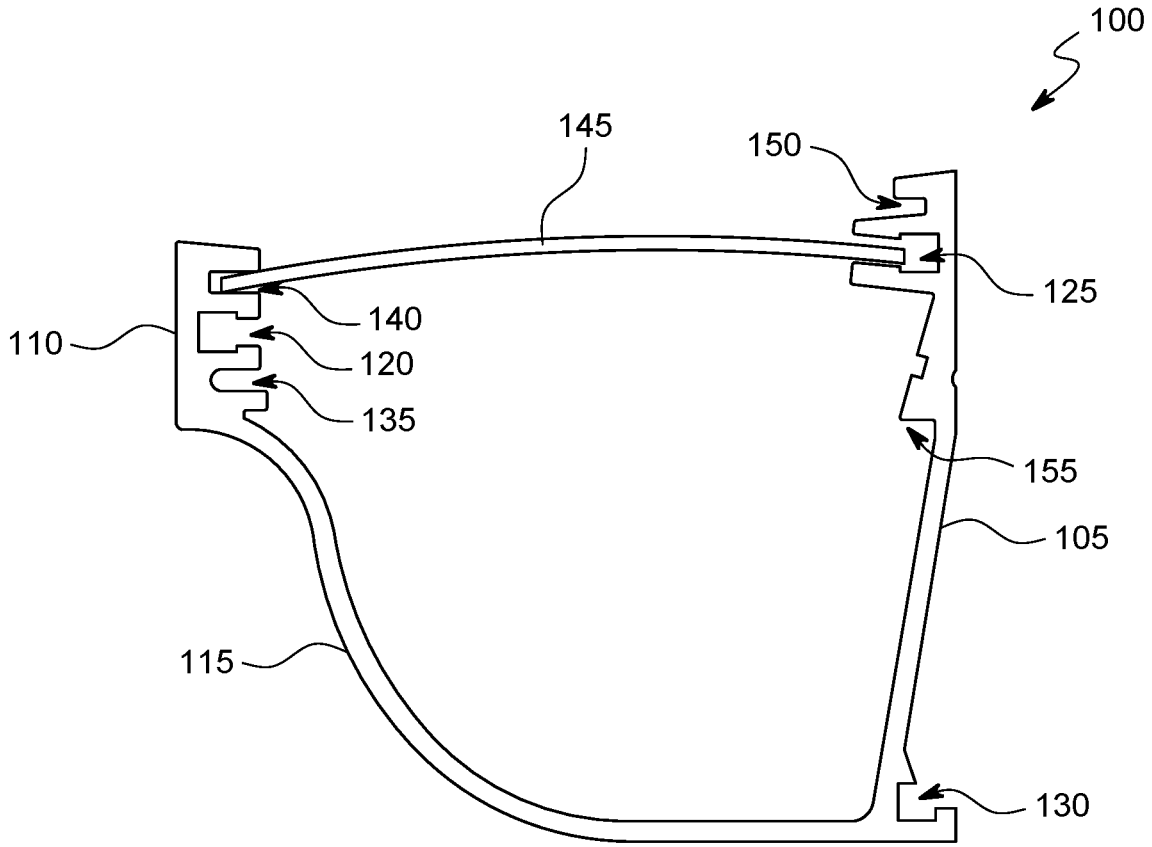
FIG. 1 is a side view of a gutter section, in accordance with an embodiment of the present invention.

Now referring to FIG. 1, which shows an exemplary embodiment of a gutter section 100 according to the present invention. As depicted in FIG. 1, the gutter section 100 comprises a rear wall 105, a front wall 110 and a base 115 forming a body of the gutter section 100. The top of the gutter section 100 is open. A keyway 120 is disposed on the front wall 110 and runs along the length of the body of the gutter section 100. Second keyway 125 is disposed on the rear wall 105 and runs along the length of the gutter section 100. A third keyway 130 is disposed at an intersection of the rear wall 105 and the base 115, and the keyway 130 runs along the length of the gutter section 100. Further can be seen a screw boss 135 disposed on the front wall 110 and the screw boss 135 running along the length of the gutter section 100. A groove 140 is disposed on the upper portion of the front wall 110 and runs along the length of the gutter section 100. The groove 140 and the keyway 125 are configured to hold a gutter guard 145 as shown in FIG. 1. Another groove 150 is provided on the top portion of the rear wall 105 and the groove 150 runs along the length of the gutter section 100. The groove 150 is configured to secure a metal flashing (not shown). An angled shelf 155 configured on rear wall 105 directs the screws for mounting the gutter section 100 to a supporting surface.

Figure 2:
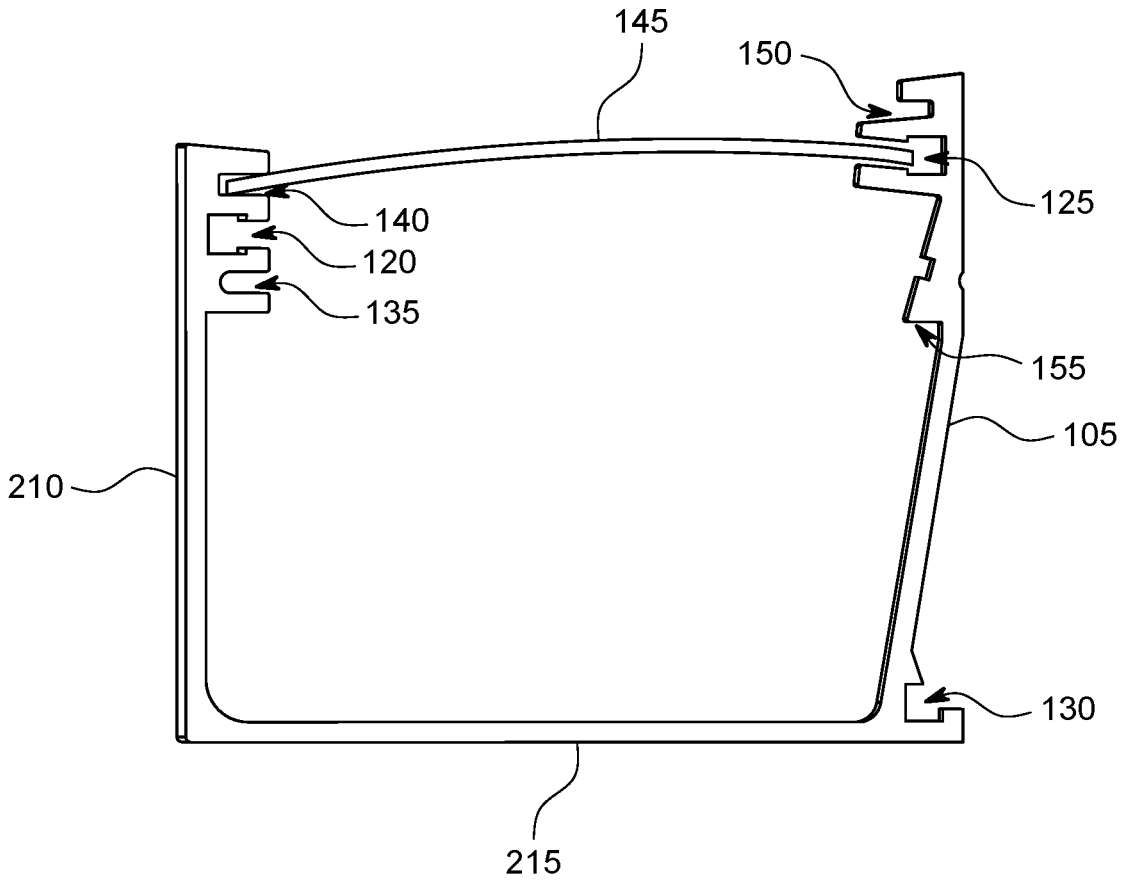
FIG. 2 is a side view of another embodiment of the gutter section, in accordance with the present invention.

The base 115 of the gutter section 100 is curved to provide an aesthetic appearance to the gutter section. It is to be noted that the gutter section can be made in any other shape without departing from the scope of the present invention. For example, FIG. 2 shows a square-shaped gutter body. The body of the gutter sections can be made of commercially available metals. Heavy-gauge aluminum has been found suitable for gutter sections, in accordance with an embodiment of the present invention, but it is within the contemplation of this invention that other materials, such as galvanized steel, copper or cuprous alloys, or even plastic might also be utilized. Preferably the gutter section in the form of a flat continuum made from metal which is strong, durable, weather-resistant, easily formed, and substantially rigid, yet susceptible to some bending without breakage. According to a preferred embodiment, an elongated gutter can be made by extrusion process and the gutter sections of the desired length can be cut from the elongated gutter. The gutters of the present invention made by the extrusion process are durable, thicker and stiffer than the gutters made by the roll forming process. Such extruded gutters can easily withstand external shocks, such as damage from a foreign object. For example, in case a ladder is supported on the installed gutter, the durable gutter of the present invention could withstand any dents that may be caused by the weight of the ladder. In one case, the thickness of the body of the gutter section can range from 0.10 inches to 0.20 inches.

The gutter section 100 shown in FIG. 1 is mounted over a supporting surface at the rear wall 105. The supporting surface in one exemplary embodiment is fascia. The term fascia herein connotes a vertical frieze or band under a roof edge. Rainwater gutters are typically installed over the fascia. The rear wall of the gutter sections is shaped according to the surface of the fascia. Shown in FIG. 1 is the flat upper portion of the rear wall 105, which can be supported over a flat supporting surface. The front wall 110 and the base 115 could be shaped to provide aesthetic appearance in the gutter section 100. For example, the front wall and the base could be shaped like ornamental wood moldings used in the buildings. It is to be understood that the terms rear wall, front wall, and the base does not limit the invention in any way. These are used to explain the structure of the gutter and does not denote any structural limitations. Moreover, the gutter could be produced in any shape as desirable, for example, a single wall U-shaped gutter or a rectangular-shaped gutter.

Figure 3:
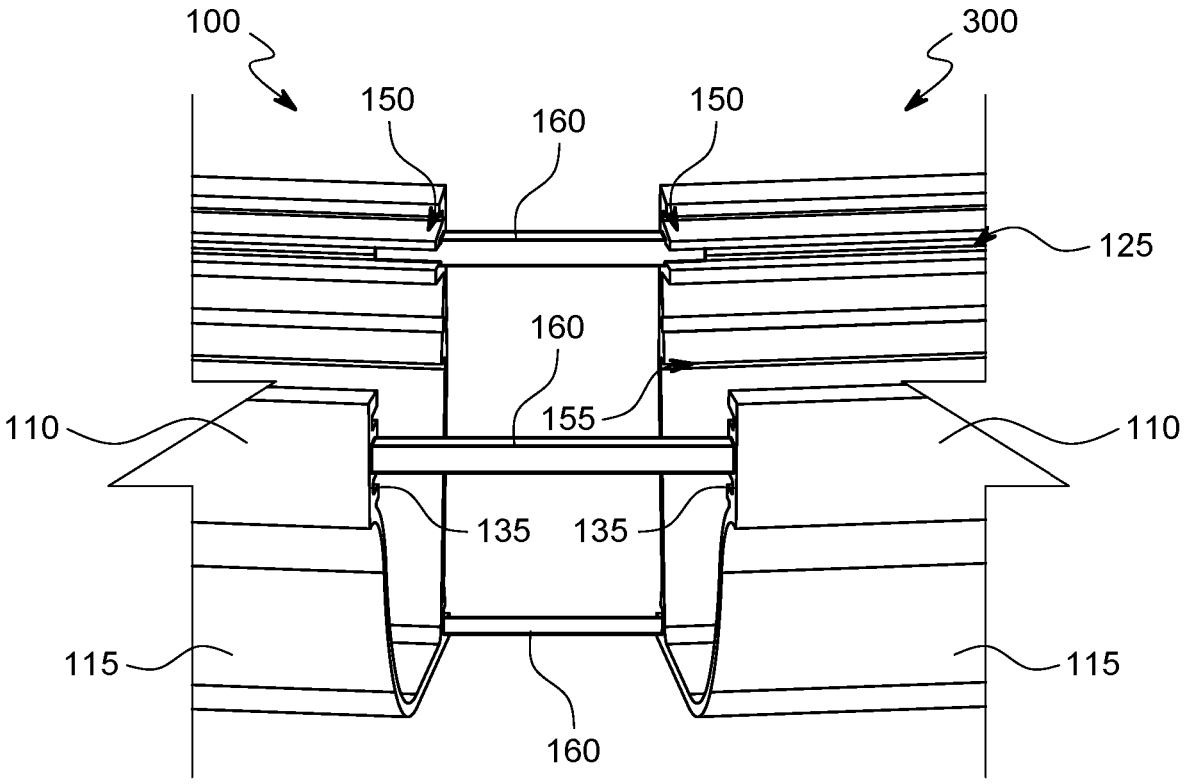
FIG. 3 shows two gutter sections of FIG. 1 connected through square shaped keys, in accordance with an embodiment of the present invention.

The keyways are used to connect two gutter sections. Elongated keys shaped to be received in the keyways are partially inserted in the keyway of the first gutter section. The second gutter section having the similar keyway is mounted over the protruding portion of the keyway, thus joining the two gutter sections. FIG. 3 shows two gutter sections connected through elongated keys. As shown in FIG. 3, the gutter section 100 of FIG. 1 is connected to second gutter section 300 through three elongated keys 160. The keyways 120, 125 and 130 shown in FIG. 1 are square-shaped, so the square-shaped keys 160 are can be used. The square-shaped elongated keys 160 is half inserted in the gutter section 100, wherein the gutter section is already mounted on the fascia. Second gutter section 300 is moved in the remaining half portion of the elongated keys 160 and then coupled to the fascia. Alternatively, the gutter can be assembled separately and then mounted on the supporting surface. Basically, the gutter sections can be joined to get the gutter of desired length and the gutter can then be mounted over the supporting surface. The gutter sections are joined similarly as described above i.e. through the keyways. It is to be understood that the figures show the keyways and the elongated keys to be square-shaped, however, the keyways and the elongated keys could be of any other shape without departing from the scope of the present invention. For example, keyway can be of a shape such as rounded, prismatic, rectangular and like. Moreover, FIG. 3 show the gutter sections connected through three keyways. It is to be understood that only one keyway can connect the two gutter sections and the other keyways are optional. Thus, the present invention can contemplate one or more keyways.

The elongated key could be bonded to the keyways using an adhesive. Alternatively, any other method obvious to a skilled person for bonding the key to the keyway is within the scope of the present invention. In one case, the keyways are positioned such as they do not obstruct in cleaning the inside of the gutter sections. For example, in FIG. 1 the keyways 120 and 125 are disposed on upper portions of the front wall 115 and the rear wall 125. The third keyway 130 is disposed in the outer portion of the intersection, thus the inner portion of the gutter section is plain that could be easily cleaned.

The gutter guard is used to keep out debris, such as leaves and twigs, without restricting the flow of water into the gutter. Structure and functions of the gutter guards are known in the prior art and any variety of different types of gutter guards can be embodied in the present invention. For example, imperforate styles, expanded metal panels, etc. can be used without any limitations. The keyway 125 in FIG. 1 is shown holding the gutter guard 145 at one side. The gutter guard 145 has ribs on the opposite side running along the length of the gutter guard 145. The ribs are configured to be slidably received into the grove 140 and the keyway 125 for mounting the gutter guard 145 over the gutter section 100. Alternatively, the gutter guard 145 can be snapped into the groove 140 and the keyway 125. It is to be noted that the gutter guard 145 and the groove 140 are optional i.e. the gutter section 100 can be contemplated without the gutter guard 145.

Figure 6:
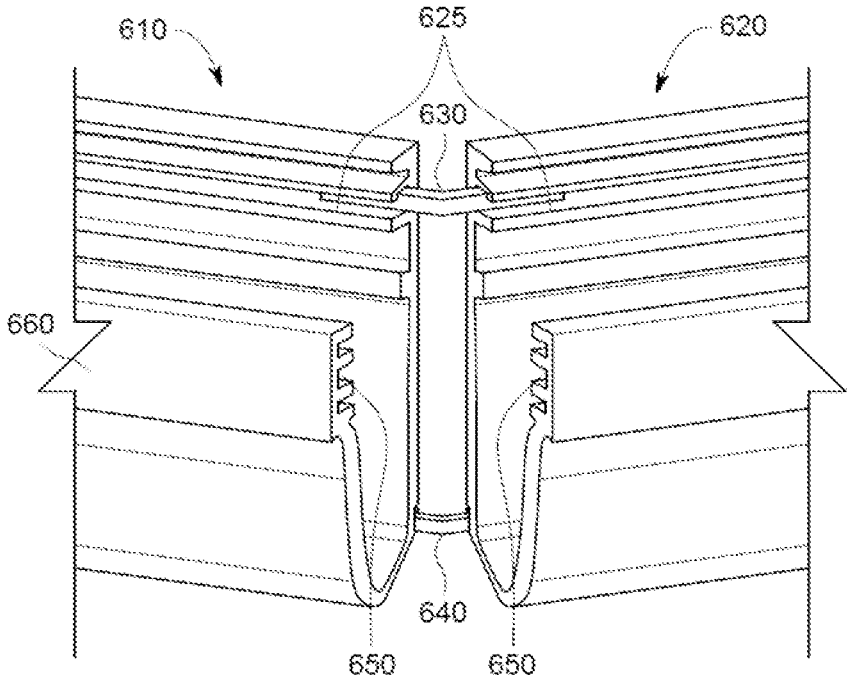
FIG. 6. shows two gutter sections of FIG. 1 connected at an angle through a bended elongated pin, in accordance with an embodiment of the present invention.

An optional screw boss 135 is shown in FIG. 1. The screw boss 135 runs parallel to the keyways and end-to-end along the length of the gutter section 100. The screw boss 135 includes a central aperture in which a fastener (not shown) is received. The fasteners like the keyways can be elongated pins used to connect two gutter sections, but at an angle other than 180 degrees. The elongated pins can be bent to the desired angle for connected the two sections in the desired angle. For example, two gutter section can be coupled perpendicularly by bending the elongated pins 90 degrees. Thus, the gutter section can be coupled at odd angles through the screw bosses, wherein the alignment pins are bent accordingly. It is to be noted that the screw bosses are optional the gutter section according to the present invention can be embodied without the screw bosses. FIG. 6 is shows two gutter sections 610 and 620 being coupled at an odd angle. The gutter sections 610 and 620 are shows at separated so that the elongated pins 630 and 640 are visible clearly. The elongated pins 630 and 640 are shown to be bended and received into the screw bosses 625 of each gutter sections 610 and 620. The gutter section further having the keyway 650 behind the front wall 660. FIG. 6 is for showing the gutter section coupled through elongated pin at an odd angle, however the end part of the gutter section be cut at an angle such that the two gutter sections can be joined.

The gutter sections are mounted over a supporting surface, such as fascia using screws. In operation, the gutter section is placed over the supporting surface and mounting screw are drilled through the wall of the gutter section into the supporting surface. Considering the shape of the gutter, and, because the screws need to be about 4" long, they have to be installed at a downward angle in order to not hit the face of the gutter as they are being installed. The wall of the gutter body is modified with an angles shelf for indexing the mounting screws. FIG. 1 shows the angles shelf 155 disposed on the rear wall 105 of the gutter section 100. The angled shelf 155 assist in drilling for the mounting screws and to prevent the drill bit from moving on the slippery surface of the gutter body wall. Furthermore, the shape (angle) of angled shelf 155 ensures that the head of the mounting screws sits flat against the inside of the gutter body wall. The present invention is advantageous that, being durable and rigid, no internal supports or external hangers may be required for installation.

Metal flashing can be used to provide a pathway for the water from the roof into the gutter. Metal flashing can be an elongated sheet extending from the roof and secured into a groove providing pathway for the water, such that water does not leak into the supporting surface. In FIG. 1 the groove 150 is provided to secure the metal flashing to the gutter section 100.

Figure 4:
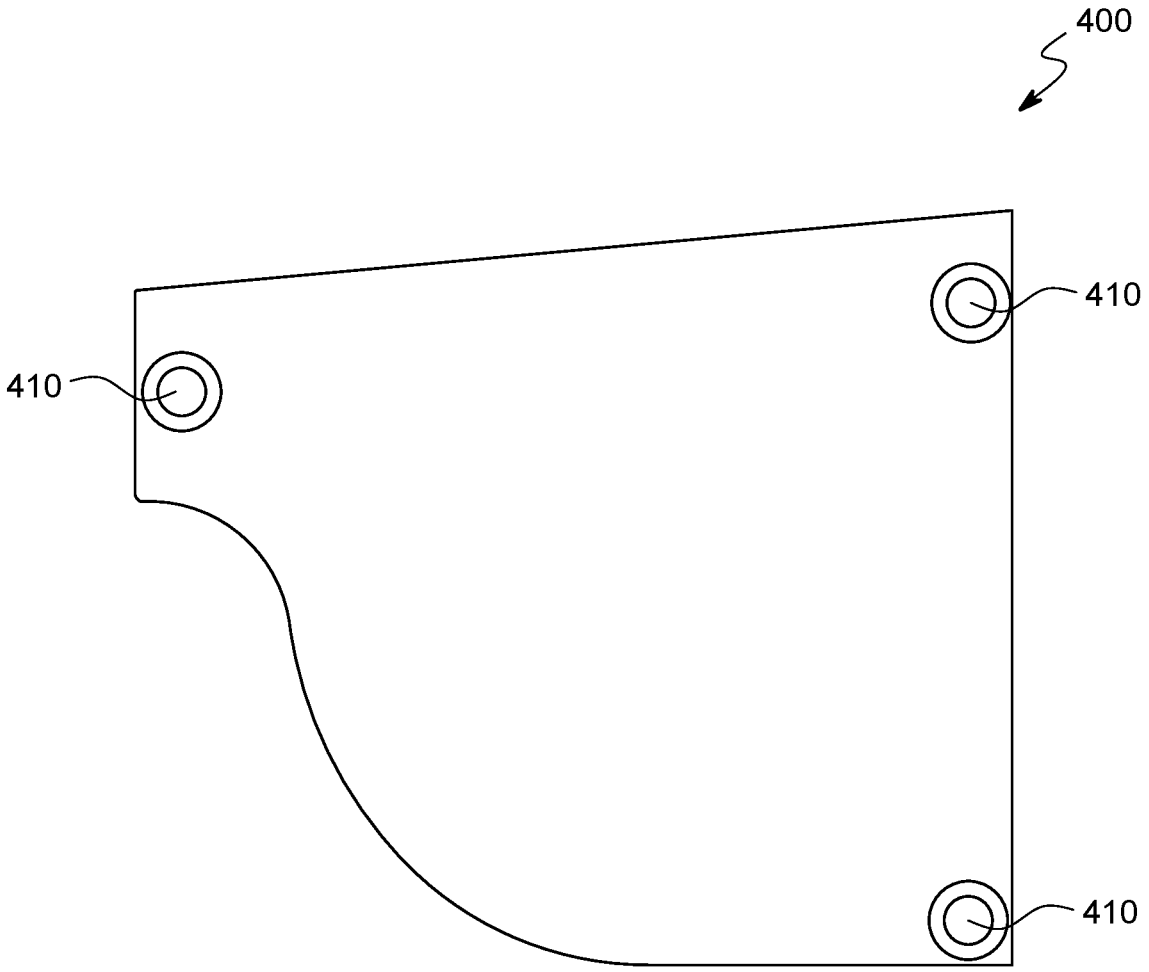
FIG. 4 shows an end cap for the gutter section of FIG. 1, in accordance with an embodiment of the present invention.

FIG. 4 shows an embodiment of an end cap 400. The end cap 400 has 3 three screws 410. The endcap is used to close the open ends of the rainwater gutter. The endcap 400 is shaped according to the gutter section of FIG. 1. The endcap 400 through the three holes 410 is screwed into the three keyways 120, 125 and 130 of the gutter section 100.

Figure 5:
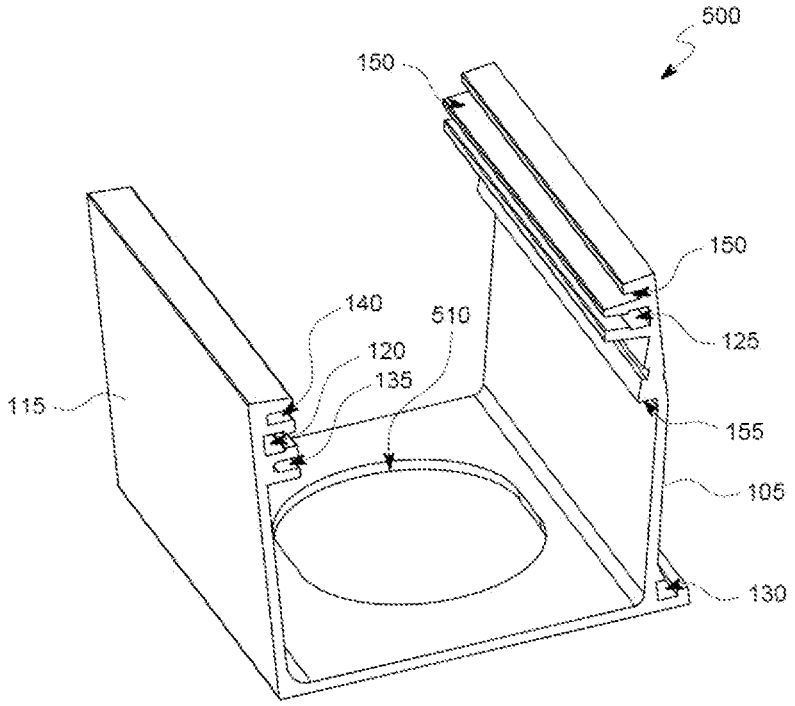
FIG. 5 shows the gutter section of FIG. 2 having a hole for connecting a downspout, in accordance with an embodiment of the present invention.

FIG. 5 shows an exemplary embodiment of gutter section 500. The gutter section 500 is like the gutter section 200 shown in FIG. 2 but having a hole 510 in the base 215 for receiving a downspout connector. Downspout channelizes the water from the gutter into a drain. Section 500 can be connected to the other section through the keyways as explained above.

While the foregoing written description of the invention enables one of ordinary skill to make and use what is considered presently to be the best mode thereof, those of ordinary skill will understand and appreciate the existence of variations, combinations, and equivalents of the specific embodiment, method, and examples herein. The invention should therefore not be limited by the above-described embodiment, method, and examples, but by all embodiments and methods within the scope and spirit of the invention as claimed.

What is claimed is:

1. A gutter section comprising:

a rear wall, a front wall, and a base together forming a gutter body, top of the gutter section is open, the gutter section further having open opposite ends;

a keyway running along the length of the gutter body;

an elongated key shaped to be slidably and snugly received into the keyway, wherein the elongated key is configured to couple the gutter section to an adjacent gutter section;

a screw boss running along the length of the gutter body; and an elongated pin shaped to be received into the screw boss, wherein the elongated pin is configured to bend for coupling the gutter section to an adjacent gutter section at a predefined angle other than 180 degrees.

2. The gutter section of claim 1, wherein the keyway and the elongated key are square shaped.

3. The gutter section of claim 2, wherein the keyway is disposed on an inner surface of the front wall.

4. The gutter section of claim 1, wherein the keyway and the elongated key are round shaped.

5. The gutter section of claim 1, wherein the gutter section is produced by an extrusion process.

6. The gutter section of claim 1, wherein the gutter section further comprises an end cap coupled to the open opposite ends of the gutter body.

7. The gutter section of claim 1, wherein the gutter section is made of metal.

8. The gutter section of claim 7, wherein the metal is aluminum having a thickness more than or equal to 0.064 inches.

9. The gutter section of claim 1, wherein the gutter section comprises two keyways running parallel and along the length of the gutter body, the first keyway disposed on the front wall and the second keyway disposed on the rear wall.

10. The gutter section of claim 1, wherein the gutter section comprises three keyways running parallel and along the length of the gutter body, the first keyway disposed on the front wall, the second keyway disposed on a top portion of the rear wall, and the third keyway disposed on a bottom portion of the rear wall.

11. The gutter section of claim 1, wherein the gutter section further comprises a groove adapted to retain a gutter guard.

12. The gutter section of claim 11, wherein the gutter section further comprises a second grove for securing a flashing, the grove disposed on a top portion of the rear wall.

13. The gutter section of claim 1, wherein one side of the keyway is configured as an elongated channel to hold a gutter guard, the keyway is disposed on a top portion of the front wall.

14. The gutter section of claim 1, wherein a portion of the rear wall of the gutter section is configured as an angled shelf.

15. A method of coupling two or more gutter sections, wherein the gutter section comprises:

a rear wall, a front wall, and a base together forming a gutter body, top of the gutter section is open, the gutter section further having open opposite ends;

a keyway running along the length of the gutter body;

an elongated key shaped to be slidably and snugly received into the keyway, wherein the elongated key is configured to couple the gutter section to a second gutter section; and a screw boss running along the length of the gutter body; and an elongated pin shaped to be received into the screw boss, wherein the elongated pin is configured to bend for coupling the gutter section to an adjacent gutter section at a predefined angle other than 180 degrees;

wherein the method comprising steps of:

supporting the gutter section over a fascia using a plurality of mounting screws;

partially inserting the elongated key into the keyway;

sliding the second gutter section along its keyway into projecting portion of the elongated key; and mounting the second gutter section over the fascia using the plurality of fasteners.

16. The method of claim 15, wherein the second gutter section comprises a hole in the base, the method further comprises connecting a downspout to the second gutter section.

17. The method of claim 15, further comprising a step of coupling an endcap to the open opposite ends.

18. The method of claim 15, wherein the keyway is square shape and the elongated key is square shaped for inserting into the keyway.

19. A gutter comprising:

a first gutter section having a first keyway running end to end along the length of the first gutter section;

a second gutter section adjacent the first gutter section, the second gutter section having a second keyway running end to end along the length of the second gutter section;

an elongated key shaped to be slidably and snugly received into the first keyway and the second keyway, wherein the elongated key is partially received into the first keyway and partially received into the second keyway for coupling the first gutter section to the second gutter section;

a screw boss running along the length of the gutter body; and an elongated pin shaped to be received into the screw boss, wherein the elongated pin is configured to bend for coupling the gutter section to an adjacent gutter section at a predefined angle other than 180 degrees.

* * * * *